United States Patent [19]

Ota et al.

[11] 4,076,533

[45] Feb. 28, 1978

[54] SILVER HALIDE EMULSION CONTAINING TWO-EQUIVALENT COUPLER

[75] Inventors: Satoshi Ota; Kotaro Nakamura; Nobuo Sakai; Nobuo Furutachi; Yukio Yokota, all of Minami-ashigara, Japan

[73] Assignee: Fuji Photo Film Co., Ltd., Minami-ashigara, Japan

[21] Appl. No.: 740,449

[22] Filed: Nov. 10, 1976

[30] Foreign Application Priority Data

Nov. 10, 1975 Japan ..... 50-135310

[51] Int. Cl.[2] ..... G03C 7/00; G03C 1/40

[52] U.S. Cl. ..... 96/56.5; 96/74; 96/100 N

[58] Field of Search ..... 96/74, 100, 56.5, 100 N

[56] References Cited

U.S. PATENT DOCUMENTS

| | | | |
|---|---|---|---|
| 3,617,291 | 11/1971 | Sawdey | 96/100 |
| 3,649,278 | 3/1972 | Iwama et al. | 96/56.5 |
| 3,930,863 | 1/1976 | Shiba et al. | 96/100 |
| 3,933,500 | 1/1976 | Shiba et al. | 96/56.5 |

*Primary Examiner*—J. Travis Brown

*Attorney, Agent, or Firm*—Sughrue, Rothwell, Mion, Zinn and Macpeak

[57] ABSTRACT

A two-equivalent color photographic coupler having advantageous properties and capable of forming a magenta color image upon coupling with an oxidation product of an aromatic primary amine developing agent, in which the carbon atom at the coupling position of the coupler is bonded to the nitrogen atom at the 1- or 4-position of a 1,2,4-triazole ring; a color photographic light-sensitive material containing the above-mentioned color photographic coupler and a method of forming a color image comprising developing an image-wise exposed photographic light-sensitive material in the presence of the above-described color photographic coupler are also described.

13 Claims, No Drawings

SILVER HALIDE EMULSION CONTAINING TWO-EQUIVALENT COUPLER

BACKGROUND OF THE INVENTION

1. Field of the Invention

The present invention relates to a color image forming coupler which is suitable for use in color photography. More particularly, it relates to a two-equivalent type magenta color image forming coupler having a novel coupling releasable group.

2. Description of the Prior Art

In a color photographic process using a silver halide light-sensitive material, a color image forming coupler which is present in a developer solution or incorporated into a photographic emulsion layer or another hydrophilic colloid layer reacts with an oxidation product of a color developing agent formed by development of an exposed silver halide emulsion layer to form a non-diffusible color image. Most conventional couplers are four-equivalent couplers, that is, theoretically, they stoichiometrically require four mols of exposed silver halide as an oxidizing agent for formation of one mol of a dye. Incorporation of a large amount of silver halide in a light-sensitive layer is disadvantageous because the sharpness of the images formed is deteriorated due to the increase of light scattering in the emulsion layer or because the rate of processing the light-sensitive material is reduced due to the increase in the thickness of the emulsion layer. Further, there is a disadvantage in the formation of dyes using these four-equivalent couplers since a strong oxidizing agent must be employed in the subsequent processing step, because the formation of the dyes is not completed in a color development bath.

In order to overcome these disadvantages, a two-equivalent coupler, that is, a coupler which requires only two mols of exposed silver halide for forming one mol of a dye, has been proposed.

A two-equivalent coupler has a structure in which one hydrogen atom at the coupling position, for example, the paraposition to the hydroxy group of a phenolic, the active methylene group at the 4-position of a 5-pyrazolone or the active methylene group of an acylacetanilide, is replaced by a group capable of being released upon coupling. Known examples of these releasable groups are a sulfonamido group, an imido group, a sulfonyl group, an aryloxy group, a thiocyano group, a carbamoyl group, an aminosulfonyloxy group, a sulfinyloxy group, and the like. However, the known two-equivalent couplers having these releasable groups are not always satisfactory, because they have disadvantages with respect to coupling reactivity, dispersibility, color fog, ease of synthesis, stability of the color image formed, and the like.

A two-equivalent type coupler having a 5-membered heterocyclic group which contains at least one nitrogen atom and an ethylenic double bond as a releasable group as described in Japanese Patent Application (OPI) No. 34232/1975 is also known. The 5-membered ring can contain at most three nitrogen atoms and in such a case the 5-membered ring having three nitrogen atoms is a 1,2,3-triazole ring. However, when a two-equivalent coupler having such a 1,2,3-triazole ring as a releasable group is incorporated into a light-sensitive material, the stability of the light-sensitive material during storage is not satisfactory.

Furthermore, of two-equivalent couplers a development inhibitor releasing coupler, the so-called DIR coupler which is used for improving the sharpness of the color image due to edge effects within a layer, reducing the graininess of the color image or achieving color corrections due to the interlayer effects, is known. However, DIR couplers generally give rise to a decrease in the maximum color density and the gradation.

SUMMARY OF THE INVENTION

An object of the present invention is to provide a two-equivalent magenta dye forming coupler having at its coupling position a substituent capable of being released upon coupling.

Another object of the present invention is to provide a two-equivalent coupler which has an appropriate coupling reaction activity and does not cause fog and stains.

A further object of the present invention is to provide a two-equivalent coupler which forms a color image having good fastness to humidity, heat and light.

A still further object of the present invention is to provide a two-equivalent magenta color forming coupler providing an excellent stability to a light-sensitive material in which the coupler is incorporated.

These objects of the present invention are accomplished with a photographic two-equivalent magenta coupler capable of coupling with an oxidation product of an aromatic primary amine developing agent in which a 1,2,4-triazole ring is bonded to the carbon atom at the coupling position through the nitrogen atom at the 1- or 4-position of the 1,2,4-triazole ring.

DETAILED DESCRIPTION OF THE INVENTION

The coupler of the present invention can provide high sensitivity, high gradation and high maximum density without forming color fog and stains, and further can provide sufficiently high maximum color density even within a short period of processing time. Thus, the coupler is suitable for use not only in a conventional processing system but also a rapid processing system.

Further, the coupler of the present invention provides particularly excellent advantages in stability of the dye image formed to moisture and heat and in the storage stability of the light-sensitive material containing the coupler. Therefore, such is suitable as a coupler for forming images.

The coupler of the present invention is preferably represented by the following general formula (I) or (II):

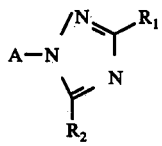

(I)

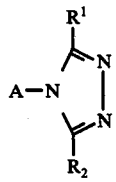

(II)

wherein A represents a residue of a magenta color image forming coupler from which one of the hydrogen atoms on the active methylene group (the coupling position) is eliminated; and $R_1$ and $R_2$, which may be the same or different, each represents a hydrogen atom, an alkyl group, an aryl group, an aralkyl group, a heterocyclic group, an amino group, an alkylamino group, an acylamino group, a sulfonamido group, a ureido group, a thioureido group, a urethane group, a thiourethane group, a carbamoyl group, a thiocarbamoyl group, an alkoxycarbonyl group, an aryloxycarbonyl group, a carboxy group, an alkylcarbonyl group or an arylcarbonyl group.

Examples of the magenta color image forming coupler residue represented by A include a coupler residue having a 5-oxo-2-pyrazoline nucleus or a pyrazolo-[1,5-a]benzimidazole nucleus.

In the general formulae (I) and (II), $R_1$ and $R_2$, which may be the same or different, each represents a group having 1 to 40 carbon atoms, preferably 1 to 22 carbon atoms, including a straight chain or branched chain alkyl group (for example, a methyl, ethyl, isopropyl, n-butyl, tert-butyl, hexyl, heptadecyl, etc., group), an alkenyl group (for example, an allyl, oleyl, etc., group), a cycloalkyl group (for example, a cyclohexyl, cyclohexylmethyl, etc., group), a cycloalkenyl group (for example, a cyclohexenyl, etc., group), an aralkyl group (for example, a benzyl, p-nitrobenzyl, β-phenylethyl, etc., group), but the invention should not be construed as being limited to these examples. These groups can be substituted with one or more substituents such as a halogen atom (e.g., a bromine, chlorine, etc., atom), a nitro group, a cyano group, an alkoxy group (e.g., a methoxy, butoxy, octyloxy, etc., group), an aryloxy group (e.g., a phenoxy, tolyloxy, naphthoxy, etc., group), a carboxy group, an alkylcarbonyl group (e.g., a methylcarbonyl, octylcarbonyl, etc., group), an alkylthiocarbonyl group (e.g., a methylthiocarbonyl, octylthiocarbonyl, etc., group), an arylcarbonyl group (e.g., a phenylcarbonyl, tolylcarbonyl, naphthylcarbonyl, etc., group), an arylthiocarbonyl group (e.g., a phenylthiocarbonyl, tolylthiocarbonyl, etc., group), an alkoxycarbonyl group (e.g., a methoxycarbonyl, butoxycarbonyl, octyloxycarbonyl, etc., group), an aryloxycarbonyl group (e.g., a phenoxycarbonyl, tolyloxycarbonyl, etc., group), a sulfo group, an acyloxy group (e.g., an acetoxy, octylcarbonyloxy, etc., group), a sulfamoyl group (e.g., an N-methylsulfamoyl, N,N-diethylsulfamoyl, N-methyl-N-phenylsulfamoyl, etc., group), a carbamoyl group (e.g., an N-ethylcarbamoyl, N-methyl-N-decylcarbamoyl, N-phenylcarbamoyl, etc., group), a thiocarbamoyl group (e.g., an N-ethylthiocarbamoyl, N-methyl-N-decylthiocarbamoyl, N-phenylthiocarbamoyl, etc., group), an acylamino group (e.g., an acetamido, butyramido, benzamido, etc., group), a diacylamino group (e.g., a succinimido, phthalimido, hydantoinyl, etc., grouup), a ureido group (e.g., an ethylureido, phenylureido, chlorophenylureido, etc., group), a thioureido group (e.g., an ethylthioureido, phenylthioureido, chlorophenylthioureido, etc., group), a urethane group (e.g., a methoxycarbonylamino, octyloxycarbonylamino, etc., group), a thiourethane group (e.g., a methoxythiocarbonylamino, octyloxythiocarbonylamino, etc., group), a sulfonamido group (such as an alkylsulfonamido (e.g., methylsulfonamido, ethylsulfonamido, etc.), arylsulfonamido (e.g., phenylsulfonamido, etc.), etc., group), a heterocyclic group (e.g., a 5-membered or 6-membered ring containing a nitrogen atom (for example, a pyridyl, quinolyl, pyrrolyl, etc., group, which can be substituted with a substituent as described for the aryl group for $R_1$ or $R_2$); or two or more nitrogen atoms (for example, a pyrazolyl, benzotriazolyl, tetrazolyl, etc., group); an oxygen atom (for example, an unsubstituted or substituted furyl, benzofuranyl, etc., group having a substituent as described above for the aryl group for $R_1$ or $R_2$); a sulfur atom (for example, an unsubstituted or substituted thienyl, benzo[b]thienyl, etc., group having a substituent as described above for the aryl group for $R_1$ or $R_2$); and a heterocyclic group containing two or more different hetero atoms (such as a benzoazolyl, benzothiazolyl, etc., group)), an arylsulfonyloxy group (e.g., a phenylsulfonyloxy, tolylsulfonyloxy, etc., group), an alkylsulfonyloxy group (e.g., a methylsulfonyloxy, dodecylsulfonyloxy, etc., group), an arylsulfonyl group (e.g., a phenylsulfonyl, tolylsulfonyl, etc., group), an alkylsulfonyl group (e.g., a methylsulfonyl, octylsulfonyl, etc., group), an arylthio group (e.g., a phenylthio, tolylthio, etc., group), an alkylthio group (e.g., a methylthio, octylthio, dodecylthio, etc., group), an alkylsulfinyl group (e.g., a methylsulfinyl, hexylsulfinyl, etc., group), an arylsulfinyl group (e.g., a phenylsulfinyl, tolylsulfinyl, etc., group), an alkylamino group (e.g., a methylamino, butylamino, etc., group), a dialkylamino group (e.g., an N,N-diethylamino, N-methyl-N-decylamino, etc., group), an anilino group, an N-arylanilino group (e.g., an N-phenylanilino, etc., group), an N-alkylanilino group (e.g., an N-methylanilino, etc., group), an N-acylanilino group (e.g., a 2-chloro-5-tetradecanamidoanilino, etc., group), a hydroxy group, a mercapto group, etc. The number of the carbon atoms present in the alkyl moiety of these substituents is preferably 1 to 22.

Examples of suitable aryl groups represented by $R_1$ or $R_2$ are phenyl, naphthyl, etc.; examples of heterocyclic groups are a 5- to 7-membered ring containing one or more of a nitrogen atom, an oxygen atom or a sulfur atom as a hetero atom, such as pyridyl, quinolyl, furyl, benzothiazolyl, oxazolyl, benzoxazolyl, benzimidazolyl, naphthoxazolyl, etc. The benzene ring of the aryl group of the heterocyclic group can be substituted with one or more substituents such as an alkyl group (e.g., a methyl, ethyl, isopropyl, tert-butyl, hexyl, dodecyl, docosyl, etc., group), an alkenyl group (e.g., an allyl, β-vinylethyl, etc., group), a cycloalkyl group (e.g., a cyclohexyl, norbornyl, 7,7-dialkylnorbornyl, 2-pentadecyl-7,7-dialkylnorbornyl, etc., group), an aralkyl group (e.g., a benzyl, β-phenylethyl, etc., group), a cycloalkenyl group (e.g., a cyclopentenyl, cyclohexenyl, etc., group), a halogen atom (e.g., a chlorine, bromine, fluorine, etc., atom), a nitro group, a cyano group, an aryl group (e.g., a phenyl, tolyl, methoxyphenyl, naphthyl, etc., group), an alkoxy group (e.g., a methoxy, butoxy, octyloxy, etc., group), an aryloxy group (e.g., a phenoxy, tolyloxy, naphthoxy, etc., group), a carboxy group, an alkylcarbonyl group (e.g., a methylcarbonyl, octylcarbonyl, etc., group), an arylcarbonyl group (e.g., a phenylcarbonyl, tolylcarbonyl, etc., group), an alkoxycarbonyl group (e.g., a methoxycarbonyl, butoxycarbonyl, etc., group), an aryloxycarbonyl group (e.g., a phenoxycarbonyl, tolyloxycarbonyl, etc., group), a sulfo group, an acyloxy group (e.g., an acetoxy, octylcarbonyloxy, etc., group), a sulfamoyl group (e.g., an N-methylsulfamoyl, N,N-diethylsulfamoyl, N-methyl-N-phenylsulfamoyl, etc., group), a carbamoyl group (e.g., an N-ethylcarbamoyl, N-methyl-N-decylcarbamoyl, N-phenylcarbamoyl, etc., group), an acylamino group (e.g., an acetamido, butyramido, benzamido, etc., group), a diacylamino group (e.g., a succinimido, phthalimido, hydantoinyl, etc., group), a ureido group (e.g., an ethylureido, phenylureido, chlorophenylureido, etc., group), a thioureido group (e.g., an ethylthioureido, phenylthioureido, chlorophenylthioureido, etc., group), a urethane group (e.g., a methoxycarbonylamino, octyloxycarbonylamino, etc., group), a thiourethane group (e.g., a methoxythiocarbonylamino, octyloxythiocarbonylamino, etc., group), a sulfonamido group (such as an alkylsulfonamido (e.g., methylsulfonamido, ethylsulfonamido, etc.), arylsulfonamido (e.g., phenylsulfonamido, etc.), etc., group), a heterocyclic group (e.g., a 5- or 6-membered heterocyclic group or condensed heterocyclic group containing at least one hetero atom selected from nitrogen, oxygen and sulfur atoms, such as a furyl, oxazolyl, benzothiazolyl, imidazolyl, etc., group), and arylsulfonyloxy group (e.g., a phenylsulfonyloxy, tolylsulfonyloxy, dodecylsulfonyloxy, etc., group), an alkylsulfonyloxy group (e.g., an ethylsulfonyloxy, dodecylsulfonyloxy, etc., group), an arylsulfonyl group (e.g., a phenylsulfonyl, tolylsulfonyl, etc., group), an alkylsulfonyl group (e.g., a methylsulfonyl, octylsulfonyl, etc., group), an arylthio group (e.g., phenylthio, tolylthio, naphthothio, etc., group), an alkylthio group (e.g., a methylthio, octylthio, dodecylthio, etc., group), an alkylsulfinyl group (e.g., a methylsulfinyl, hexylsulfinyl, etc., group), an arylsulfinyl group (e.g., a phenylsulfinyl, tolylsulfinyl, etc., group), an alkylamino group (e.g., methylamino, t-butylamino, octylamino, etc., group), a dialkylamino group (e.g., an N,N-diethylamino, N-methyl-N-decylamino, etc., group), an anilino group, an N-arylanilino group (e.g., an N-phenylanilino, etc., group), an N-alkylanilino group (e.g., an N-methylanilino, etc., group), an N-acylanilino group (e.g., a 2-chloro-5-tetradecanamidoanilino, etc., group), a hydroxy group, a mercapto group, etc. The number of the carbon atoms present in the alkyl moiety of these substituents is preferably 1 to 22.

Examples of alkylamino and dialkylamino groups represented by $R_1$ or $R_2$ are dimethylamino, butylamino, diethylamino, benzylamino, piperidino, morpholino, etc.

Examples of arylamino groups (e.g., anilino and substituted anilino groups) for $R_1$ and $R_2$ are anilino, N-methylanilino, diphenylamino, etcl; examples of acylamino groups are acetylamino, diacetylamino, benzamido, alkyl-substituted phenoxyacetamidobenzamido, N-methylpropionamido, N-phenylacetamido, etc.; examples of sulfonamido groups are methylsulfonamido, phenylsulfonamido, etc.; examples of ureido groups are ureido, N-phenylureido, N'-methylureido, etc.; examples of thioureido groups are thioureido, N'-phenylthio ureido, N'-methylthioureido, etc.; examples of carbamoyl groups are carbamoyl, ethylcarbamoyl, dimethylcarbamoyl, phenylcarbamoyl, N-methylphenylcarbamoyl, etc.; examples of thiocarbamoyl groups are thiocarbamoyl, methylthiocarbamoyl, etc.; examples of alkoxycarbonyl groups are ethoxycarbonyl, butoxycarbonyl, benzyloxycarbonyl, etc.; examples of aryloxycarbonyl groups are phenoxycarbonyl, etc.; examples of alkylcarbonyl groups are acetyl, propionyl, pivaloyl, etc.; examples or arylcarbonyl groups are benzoyl, etc.

Preferred groups for $R_1$ and $R_2$ are an alkyl group (e.g., a methyl, ethyl, isopropyl, tert-butyl, hexyl, dodecyl, docosyl, etc., group), an amido group (e.g., an acetylamino, butylcarbonylamino, octylcarbonylamino, etc., group), a benzyl group, a carboxy group, an amino group (including an alkylamino or arylamino group as described hereinbefore), an alkoxycarbonyl group (e.g., a methoxycarbonyl, butoxycarbonyl, octyloxycarbonyl, etc., group), an alkoxyalkyl group (e.g., a 2-methoxyethyl, 3-butoxymethyl, 2-ethoxyethyl, etc., group), a phenyl group, a p-chlorophenyl group, a p-carboxyphenyl group, a pyridyl group and a sulfonamido group (such as an alkylsulfonamido (e.g., methylsulfonamido, ethylsulfonamido, etc.), arylsulfonamido (e.g., phenylsulfonamido, etc.), etc., group).

The residue represented by A which is particularly useful in the present invention is represented by the general formula (III) or (IV):

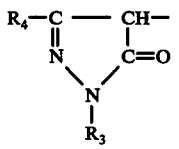

(III)

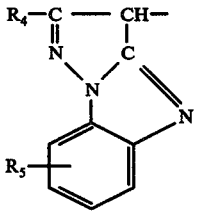

(IV)

In the general formula (III), $R_3$ represents a group having 1 to 40 carbon atoms, preferably 1 to 22 carbon atoms, including a straight chain or branched chain alkyl group (for example, a methyl, isopropyl, tert-butyl, hexyl, dodecyl, etc., group), an alkenyl group (for example, an allyl, etc., group); a cycloalkyl group (for example, a cyclopentyl, cyclohexyl, norbornyl, etc., group), an aralkyl group (for example, a benzyl, β-phenylethyl, etc., group), a cycloalkenyl group (for example, a cyclopentenyl, cyclohexenyl, etc., group), etc. These groups can be also substituted with one or more of a halogen atom (e.g., a chlorine, bromine, fluorine, etc., atom) and a nitro group, a cyano group, an aryl group (e.g., a phenyl, tolyl, methoxyphenyl, chlorophenyl, naphthyl, etc., group), an alkoxy group (e.g., a methocy, butoxy, octyloxy, etc., group), an aryloxy group (e.g., a phenoxy, tolyloxy, naphthoxy, etc., group), a carboxy group, an alkylthiocarbonyl group (e.g., a methylthiocarbonyl, octylthiocarbonyl, etc., group), an arylthiocarbonyl group (e.g., a phenylthiocarbonyl, tolylthiocarbonyl, etc. group), an alkoxycarbonyl group (e.g., a methoxycarbonyl, octyloxycarbonyl, etc., group), an aryloxycarbonyl group (e.g., a phenoxycarbonyl, tolyloxycarbonyl, naphthoxycarbonyl, etc., group), a sulfo group, a sulfamoyl group (e.g., an N-methylsulfamoyl, N,N-diethylsulfamoyl, N-methyl-N-phenylsulfamoyl, etc., group), a carbamoyl group (e.g., an N-ethylcarbamoyl, N-methyl-N-decylcarbamoyl, N-phenylcarbamoyl, etc., group), an acylamino group (e.g., an acetamido, butyramido, octanoylamino, banzamido, etc., group), a diacylamino group (e.g., an N,N-diacetylamino, N-acetyl-N-butanoylamino, phthalimido, 3-heptadecylsuccinimido, etc., group), a ureido group (e.g., an ethylureido, phenylureido, chlorophenylureido, etc., group), a urethane group (e.g., a methoxycarbonylamino, acetyloxycarbonylamino, etc., group), a thiourethane group (e.g., a methoxythiocarbonylamino, octyloxythiocarbonylamino, etc., group), a sulfonamido group (such as an alkylsulfonamido (e.g., methylsulfonamido, ethylsulfonamido, etc.), arylsulfonamido (e.g., phenylsulfonamido, etc.), etc., group), a heterocyclic group (e.g., 5- or 6-membered heterocyclic group or condensed heterocyclic group containing at least one hetero atom selected from nitrogen, oxygen and sulfur atoms, such as furyl, oxazolyl, benzothiazolyl, imidazolyl, etc.), an arylsulfonyl group (e.g., a phenylsulfonyl, tolylsulfonyl, etc., group), an alkylsulfonyl group (e.g., a methylsulfonyl, hexylsulfonyl, etc., group), an arylthio group (e.g., a phenylthio, tolylthio, etc., group), an alkylthio group (e.g., a methylthio, octylthio, dodecylthio, etc., group), an alkylamino group (e.g., a methylamino, butylamino, etc., group), a dialkylamino group (e.g., an N,N-diethylamino, N-methyl-N-decylamino, etc., group), an anilino group, an N-arylanilino group (e.g., an N-phenylanilino, etc., group), an N-alkylanilino group (e.g., an N-methylanilino, etc., group), an N-acylanilino group (e.g., a 2-chloro-5-tetradecanamidoanilino, etc., group), a hydroxy group or a mercapto group.

Further, $R_3$ represents an aryl group (for example, a phenyl, α- or β-naphthyl, etc., group). The aryl group also can be substituted with one or more substituents. Suitable substituents are, for example, a halogen atom (e.g., a chlorine, bromine, fluorine, etc., atom) and an alkyl group (e.g., a methyl, ethyl, isopropyl, t-butyl, hexyl, dodecyl, docosyl, etc., group), an alkenyl group (e.g., an allyl, β-vinylethyl, etc., group), a cycloalkyl group (e.g., a cyclohexyl, norbornyl, 7,7-dialkylnorbornyl, 2-pentadecyl-7,7-dialkylnorbornyl, etc., group), an aralkyl group (e.g., a benzyl, β-phenylethyl, etc., group), a cycloalkenyl group (e.g., a cyclopentenyl, cyclohexenyl, etc., group), a nitro group, a cyano group, an aryl group (e.g., a phenyl, tolyl, methoxyphenyl, naphthyl, etc., group), an alkoxy group (e.g., a methoxy, butoxy, octyloxy, etc., group), an aryloxy group (e.g., a phenoxy, tolyloxy, naphthoxy, etc., group), a carboxy group, an alkoxycarbonyl group (e.g., a methoxycarbonyl, butoxycarbonyl, etc., group), an aryloxycarbonyl group (e.g., a phenoxycarbonyl, tolyloxycarbonyl, etc., group), a sulfo group, a sulfamoyl group (e.g., an N-methylsulfamoyl, N,N-diethylsulfamoyl, N-methyl-N-phenylsulfamoyl, etc., group), a carbamoyl group (e.g., an N-ethylcarbamoyl, N-methyl-N-decylcarbamoyl, N-phenylcarbamoyl, etc., group), an acylamino group (e.g., an acetamido, butyramido, benzamido, etc., group), a diacylamino group (e.g., a phthalimido, 3-heptadecylsuccinimido, etc., group), a ureido group (e.g., an ethylureido, phenylureido, chlorophenylureido, etc., group), a urethane group (e.g., a methoxycarbonylamino, acetyloxycarbonylamino, etc., group), a sulfonamido group (such as an alkylsulfonamido (e.g., methylsulfonamido, ethylsulfonamido, etc.), arylsulfonamido (e.g., phenylsulfonamido, etc.), etc., group), a heterocyclic group (e.g., a 5- or 6-membered heterocyclic group or condensed heterocyclic group containing at least one hetero atom selected from nitrogen, oxygen and sulfur atoms, such as a furyl, oxazolyl, benzothiazolyl, imidazolyl, etc., group), an arylsulfonyl group (e.g., a phenylsulfonyl, tolylsulfonyl, etc., group), an alkylsulfonyl group (e.g., a methylsulfonyl, octylsulfonyl, etc., group), an arylthio group (e.g., a phenylthio, tolylthio, etc., group), an alkylthio group (e.g., a methylthio, octylthio, dodecylthio, etc., group), an alkylamino group (e.g., a methylamino, butylamino, etc., group), a dialkylamino (e.g., an N,N-diethylamino, N-methyl-N-decylamino, etc., group), an anilino group, an N-alkylanilino group (e.g., an N-methylanilino, etc., group), an N-arylanilino group (e.g., an N-phenylanilino, etc., group), an N-acylanilino group (e.g., 2-chloro-5-tetradecanamidoanilino, etc., group), a hydroxy group or a mercapto group. A phenyl group in which at least one of the ortho-position is substituted with an alkyl group (e.g., a methyl, ethyl, octyl, etc., group), an alkoxy group (e.g., a methoxy, butoxy, octyloxy, etc., group) or a halogen atom (e.g., a chlorine, bromine, fluorine, etc., atom) is preferably used for $R_3$, since when the coupler remains in a color photographic material after development, less coloration due to the action of light or heat occur.

Furthermore, $R_3$ represents a heterocyclic group (for example, a 5-membered or 6-membered heterocyclic group or a condensed heterocyclic group containing one or more of a nitrogen atom, an oxygen atom or a sulfur atom, as a hetero atom, such as a pyridyl, quinolyl, furyl, benzothiazolyl, oxazolyl, imidazolyl, naphthoxazolyl group, etc.; a substituted heterocyclic group substituted with one or more substituents as above described for the aryl group; an aliphatic or aromatic acyl group (e.g., an acetyl, propanoyl, octanoyl, etc., group); an alkylsulfonyl group (e.g., a methylsulfonyl, butylsulfonyl, octylsulfonyl, etc., group); an arylsulfonyl group (e.g., a phenylsulfonyl, tolylsulfonyl, etc., group); an alkylcarbamoyl group (e.g., a methylcarbamoyl, butylcarbamoyl, octylcarbamoyl, etc., group); an arylcarbamoyl group (e.g., a phenylcarbamoyl, tolylcarbamoyl, etc., group); an alkylthiocarbamoyl group (e.g., a methylthiocarbamoyl, butylthiocarbamoyl, etc., group) or an arylthiocarbamoyl group (e.g., a phenylthiocarbamoyl, tolythiocarbamoyl, etc., group).

In the formula, $R_4$ represents a hydrogen atom or a group having 1 to 40 carbon atoms, preferably 1 to 22 carbon atoms, including a straight chain or branched chain alkyl group (e.g., a methyl, ethyl, isopropyl, t-butyl, hexyl, dodecyl, docosyl, etc., group), an alkenyl group (e.g., an allyl, β-vinylethyl, etc., group), a cycloalkyl group (e.g., a cyclohexyl, norbornyl, 7,7-dialkylnorbornyl, 2-pentadecyl-7,7-dialkylnorbornyl, etc., group), an aralkyl group (e.g., a benzyl, β-phenylethyl, etc., group) and a cycloalkenyl group (e.g., a cyclopentenyl, cyclohexenyl, etc., group) (these groups can contain one or more substituents above described for $R_3$), an aryl group or a heterocyclic group (e.g., a 5- or 6-membered heterocyclic group or condensed heterocyclic group containing at least one hetero atom selected from nitrogen, oxygen and sulfur atoms, such as a furyl, oxazolyl, benzothiazolyl, imidazolyl, etc., group) (these groups can have substituents above described for $R_3$), an alkoxycarbonyl group (for example, a methoxycarbonyl, ethoxycarbonyl, stearyloxycarbonyl, etc., group), an aryloxycarbonyl group (for example, a phenoxycarbonyl, naphthoxycarbonyl, etc., group), an aralkyloxycarbonyl group (for example, a benzyloxycarbonyl, etc., group), an alkoxy group (for example, a methoxy, ethoxy, heptadecyloxy, etc., group) an aryloxy group (for example, a phenoxy, tolyloxy, etc., group), an alkylthio group (for example, an ethylthio, dodecylthio, etc., group), an arylthio group (for example, a phenylthio, α-naphthylthio, etc., group), a carboxy group, an acylamino group (for example, an acetamido, 3-[(2,4-di-tert-amylphenoxy)acetamido]benzamido, etc., group), a diacylamino group (e.g., a phthalimido, 3-heptadecylsuccinimido, etc., group), an N-alkylacylamino group (for example, an N-methylpropionamido, etc., group), an N-arylacylamino group (for example, an N-phenylacetamido, etc., group), a ureido group (such as a ureido, N-arylureido, N-alkylureido, etc., group (e.g., an ethylureido, phenylureido, chlorophenylureido, etc., group)), a urethane group (e.g., a methoxycarbonylamino, acetyloxycarbonylamino, etc., group), a thiourethane group (e.g., a methoxythiocarbonylamino, octyloxythiocarbonylamino, etc., group), an arylamino group (for example, a phenylamino, N-methylanilino, diphenylamino, N-acetylanilino, 2-chloro-5-tetradecanamidoanilino, etc., group), an alkylamino group (for example, an n-butylamino, methylamino, cyclohexylamino, etc., group), a cycloamino group (for example, a piperidino, pyrrolidino, etc., group), a heterocyclic amino group (for example, a 4-pyridylamino, 2-benzoxazolylamino, etc., group), an alkylcarbonyl group (for example, a methylcarbonyl, etc., group), an arylcarbonyl group (for example, a phenylcarbonyl, etc., group), a sulfonamido group (such as an alkylsulfonamido, (e.g., methylsulfonamido, ethylsulfonamido, etc.), arylsulfonamino (e.g., phenylsulfonamido, etc.), etc., group), a carbamoyl group (for example, an ethylcarbamoyl, dimethylcarbamoyl, N-methyl-N-phenylcarbamoyl, N-phenylcarbamoyl, etc., group); a sulfamoyl group (such as an N-alkylsulfamoyl, N,N-dialkylsulfamoyl, N-arylsulfamoyl, N-alkyl-N-arylsulfamoyl, N,N-diarylsulfamoyl, etc., group (e.g., an N-methylsulfamoyl, N,N-diethylsulfamoyl, N-methyl-N-phenylsulfamoyl, etc., group)), a cyano group, a hydroxy group, a mercapto group, a halogen atom (e.g., a chlorine, bromine, fluorine, etc., atom) or a sulfo group.

In the formula, $R_5$ represents a hydrogen atom or a group having 1 to 32 carbon atoms, preferably 1 to 22 carbon atoms, including a straight chain or branched chain alkyl group (e.g., a methyl, ethyl, isopropyl, t-butyl, hexyl, dodecyl, docosyl, etc., group), an alkenyl group (e.g., an allyl, $\beta$-vinylethyl, etc., group), a cycloalkyl group (e.g., a cyclohexyl, norbornyl, 7,7-dialkylnorbornyl, 2-pentadecyl-7,7-dialkylnorbornyl, etc., group), an aralkyl group (e.g., a benzyl, $\beta$-phenylethyl, etc., group), a cycloalkenyl group (e.g., a cyclopentenyl, cyclohexenyl, etc., group) and these groups can contain one or more substituents above described for $R_3$.

Further, $R_5$ represents an aryl group (e.g., a phenyl, tolyl, methoxyphenyl, naphthyl, etc., group) or a heterocyclic group (e.g., a 5- or 6-membered heterocyclic group or condensed heterocyclic group containing at least one hetero atom selected from nitrogen, oxygen and sulfur atoms, such as a furyl, oxazolyl, benzothiazolyl, imidazolyl, etc., group) and these groups can contain one or more substituents above described for $R_3$.

Furthermore, $R_5$ represents a halogen atom (e.g., a chlorine, bromine, fluorine, etc., atom), a cyano group, an alkoxy group (e.g., a methoxy, butoxy, octyloxy, etc., group), an aryloxy group (e.g., a phenoxy, tolyloxy, naphthoxy, etc., group), a carboxy group, an alkoxycarbonyl group (e.g., a methoxycarbonyl, butoxycarbonyl, etc., group), an aryloxycarbonyl group (e.g., a phenoxycarbonyl, tolyloxycarbonyl, etc., group), an acyloxy group (e.g., an acetoxy, octylcarbonyloxy, etc., group), a sulfamoyl group (e.g., an N-methylsulfamoyl, N,N-diethylsulfamoyl, N-methyl-N-phenylsulfamoyl, etc., group), a carbamoyl group (e.g., an N-ethylcarbamoyl, N-methyl-N-decylcarbamoyl, N-phenylcarbamoyl, etc., group), an acylamino group (e.g., an actamido, butyramido, benzamido, etc., group), a diacylamino group (e.g., a phthalimido, 3-heptadecylsuccinimido, etc., group), a ureido group (e.g., an ethylureido, phenylureido, chlorophenylureido, etc., group), a urethane group (e.g., a methoxycarbonylamino, acetyloxycarbonylamino, etc., group), a sulfonamido group (such as an alkylsulfonamido (e.g., methylsulfonamido, ethylsulfonamido, etc.), arylsulfonamido (e.g., phenylsulfonamido, etc.), etc., group), an arylsulfonyl group (e.g., a phenylsulfonyl, tolylsulfonyl, etc., group), an alkylsulfonyl group (e.g., a methylsulfonyl, octylsulfonyl, etc., group), an arylthio group (e.g., a phenylthio, tolylthio, etc., group), an alkylthio group (e.g., a methylthio, octylthio, dodecylthio, etc., group), an alkylamino group (e.g., a methylamino, butylamino, etc., group), a dialkylamino group (e.g., an N,N-diethylamino, N-methyl-N-decylamino, etc., group), an anilino group, an N-arylanilino group (e.g., an N-phenylanilino, etc., group), an N-alkylanilino group (e.g., an N-methylanilino, etc., group), an N-acylanilino group (e.g., a 2-chloro-5-tetradecanamidoanilino, etc., group), a hydroxy group or a mercapto group.

Moieties of coupler represented by the general formula (III) or (IV) of the present invention can combine together, directly at $R_1$, $R_2$, $R_3$, $R_4$ or $R_5$ or through a divalent group derived from an $R_1$, $R_2$, $R_3$, $R_4$ or $R_5$ group capable of being divalent, to form a symmetrical or unsymmetrical complex coupler.

The magenta coupler used in the present invention provides various properties depending on the substituents $R_1$, $R_2$, $R_3$, $R_4$ and $R_5$ and this feature is applicable to various photographic objects. When at least one of $R_3$, $R_4$ and $R_5$ contains a hydrophobic group of 8 or more carbon atoms, the coupler becomes non-diffusible in the hydrophilic colloid layer of a light-sensitive material. Such a coupler can be incorporated in a silver halide emulsion layer. When $R_1$ or $R_2$ contains a diffusion resistant hydrophobic group and $R_3$, $R_4$ and $R_5$ do not contain a diffusion resistant group and at least one of $R_3$, $R_4$ and $R_5$ contains a water-solubilizing group, such as a sulfo group or a carboxy group, the coupler per se is non-diffusible but provides a diffusible dye by the oxidizing coupling reaction with an aromatic primary amine developing agent. Such a diffusible dye providing coupler is suitable for use in diffusion transfer color photography.

The diffusible coupler can be used by dissolving such in a developer solution and provided in an emulsion layer through diffusion during development to form a color image.

The diffusion resistant coupler can be used by incorporation into an emulsion layer. In order to render a coupler diffusion resistant, a ballast group containing a hydrophobic residue of 8 to 40 carbon atoms is introduced into the coupler molecule by combining the ballast group with the coupler skeleton directly or through an imino bond, an ether bond, a thioether bond, a carbonamido bond, a sulfonamido bond, a ureido bond, an ester bond, a carbonyl bond, an imido bond, a carbamoyl bond, a sulfamoyl bond, etc.

Examples of suitable ballast groups are an alkyl group, an alkoxyalkyl group, an alkenyl group, an aryl group substituted with an alkyl group, an aryl group substituted with an alkoxy group, a terphenyl group, and the like. These ballast groups can be substituted with a halogen atom such as fluorine, chlorine, etc., a nitro group, an amino group, a cyano group, an alkoxycarbonyl group, an aryloxycarbonyl group, an amido group, a carbamoyl group, a sulfamoyl group, a ureido group, a sulfonamido group, and the like.

Specific examples of ballast groups are 2-ethylhexyl, tert-octyl, n-dodecyl, 2,2-dimethyldodecyl, n-octadecyl, 2-(n-hexyl)decyl, 9,10-dichloroctadecyl, 2,4-di-tert-amylcyclohexyl, dodecyloxypropyl, oleyl, 2,4-di-tert-amylphenyl, 2,4-di-tert-amyl-6-chlorophenyl, 3-n-pentadecylphenyl, 2-dodecyloxyphenyl, 3-heptadecyloxyphenyl, o-terphenyl, perfluoroheptyl, and the like.

Further, some specific examples of the ballast groups are shown in the specific examples of the couplers of the present invention set forth below.

Particularly preferred couplers according to the present invention are represented by the following general formula (V).

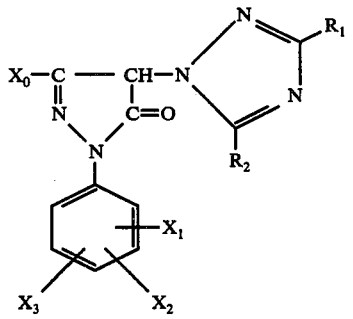

(V)

wherein $R_1$ and $R_2$ each has the same meaning as defined in the general formula (I) or (II), and preferably represents an alkyl group (e.g., a methyl, ethyl, isopropyl, t-butyl, hexyl, dodecyl, docosyl, etc., group), an amido group (e.g., an acetamido, butyramido, benzamido, etc., group), a benzyl group, a carboxy group, an amino group, an alkoxycarbonyl group (e.g., a methoxycarbonyl, butoxycarbonyl, etc., group), an alkoxyalkyl group (e.g., a methoxyethyl, butoxyethyl, etc., group), a phenyl group, a p-chlorophenyl group, a p-carboxyphenyl group, a pyridyl group or a sulfonamido group (such as an alkylsulfonamido (e.g., methylsulfonamido, ethylsulfonamido, etc.), arylsulfonamido (e.g., phenylsulfonamido, etc.), etc., group).

In the formula (V), $X_1$, $X_2$ and $X_3$, which may be the same or different, each represents a hydrogen atom, a halogen atom (for example, a chlorine, etc., atom), an alkyl group having 1 to 22 carbon atoms (for example, a methyl, octyl, octadecyl, etc., group), a sulfo group, an aryloxy group (for example, a phenoxy, etc., group), an acylamino group having 2 to 30 carbon atoms (for example, a 2,4-di-tert-pentylphenoxyacetamido, etc., group), an alkoxy group (for example, methoxy, octyloxy, octadecyloxy, etc., group) or an amido group (e.g. an acetamido, butyramido, benzamido, etc., group); $X_O$ represents a group having 1 to 32 carbon atoms, preferably 1 to 22 carbon atoms, including a straight chain or branched chain alkyl group, an alkoxy group, an acylamino group (for example, an acetamido, 3-(2,4-di-tert-pentylphenoxyacetamido)benzamido, benzamido, etc., group), a ureido group (such as a ureido, N-arylureido, N-alkylureido, etc., group (e.g., an ethylureido, phenylureido, chlorophenylureido, etc., group)) or a phenylamino group (for example, an anilino, 2-chloro-5-tetradecanamidoanilino, 2-chloro-4-{N-[3-(2,4-di-tert-pentylphenoxy)propyl]sulfamoyl}•phenylamino, 3,5-dicarboxyphenylamino, 2,4-dichlorophenylamino, 2-chloro-5-[2-carboxymethyl(2-nonadecanamido)]phenylamino, etc., group).

Specific examples of the couplers according to the present invention are set forth below, but the present invention is not to be construed as being limited to only these couplers.

(1)

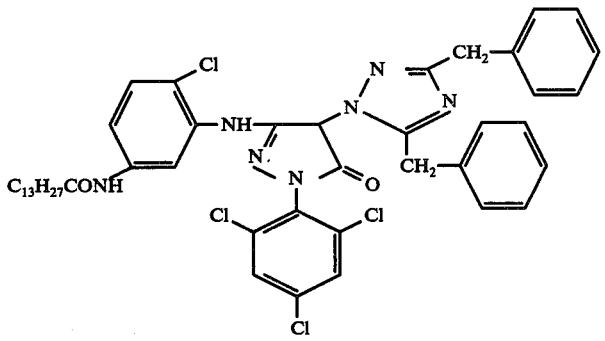

(2)

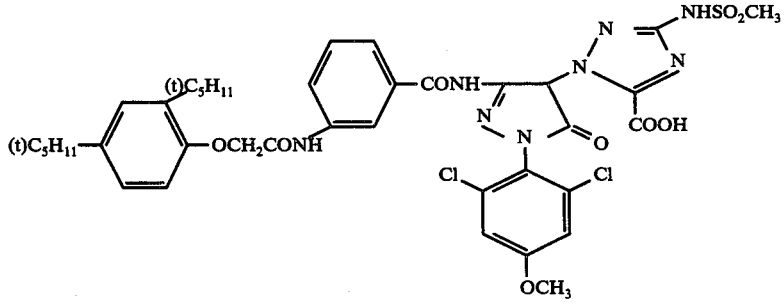

-continued
(3)
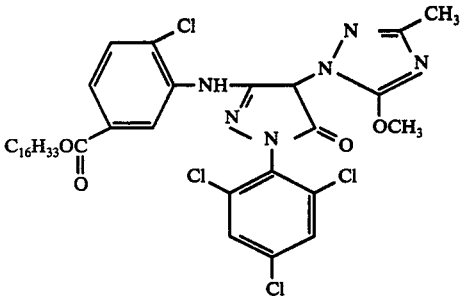
(4)
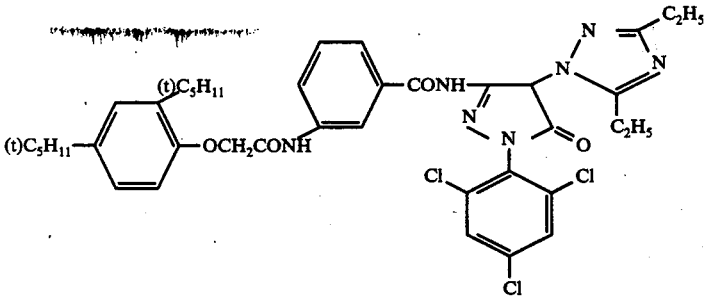
(5)
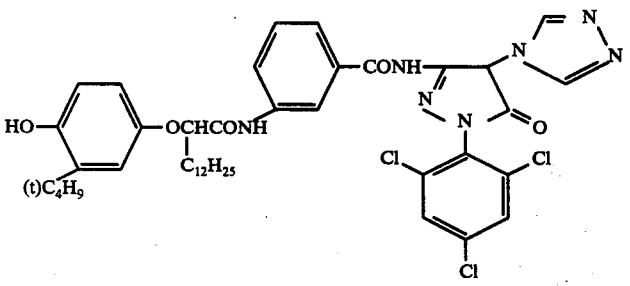
(6)
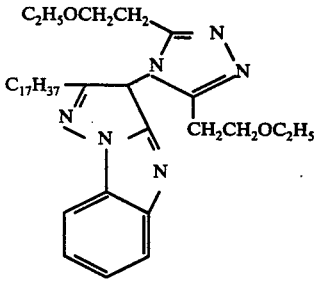
(7)
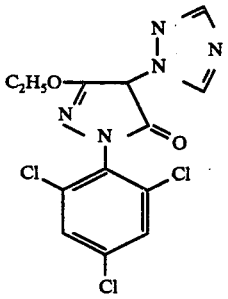

-continued
(8)
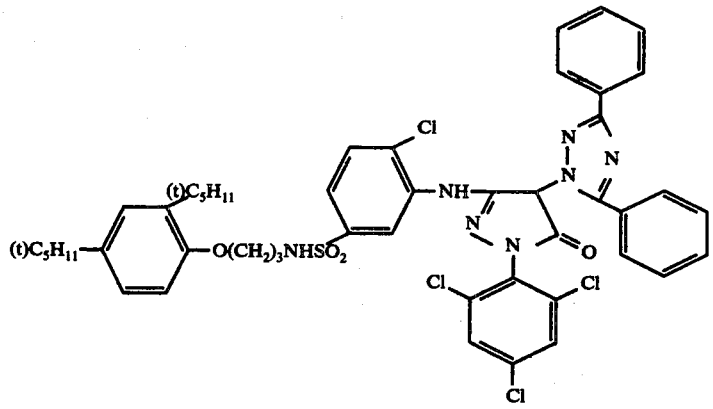
(9)
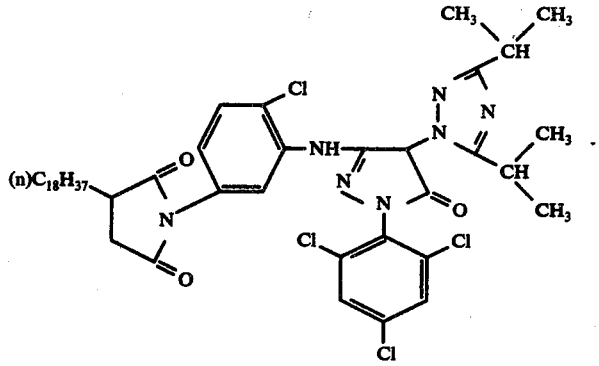
(10)
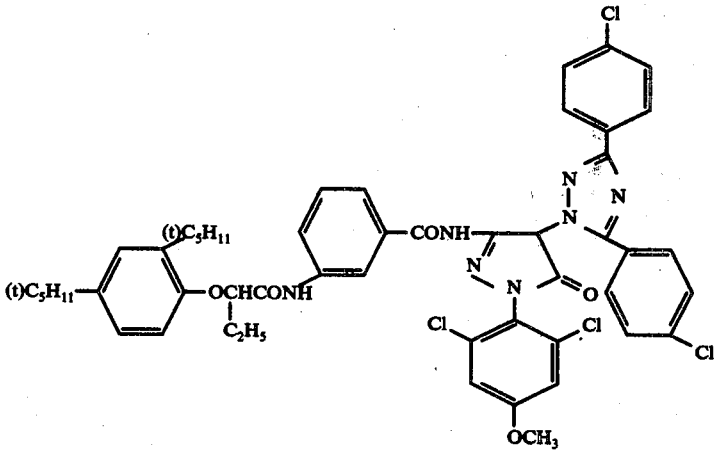
(11)
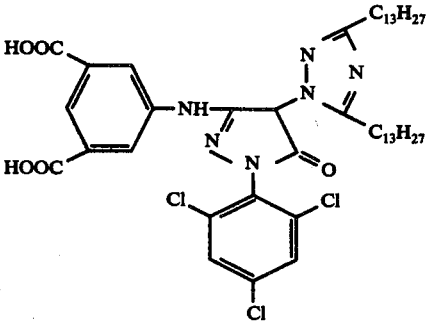

-continued
(12)
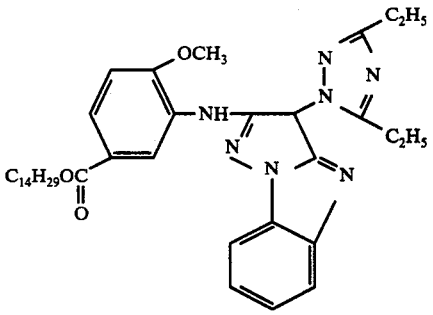
(13)
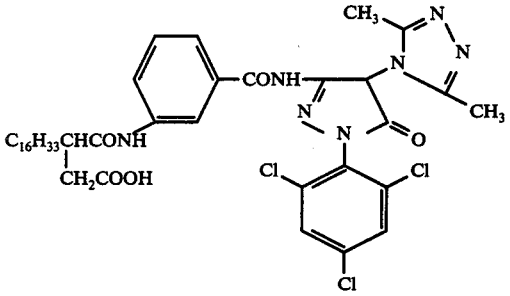
(14)
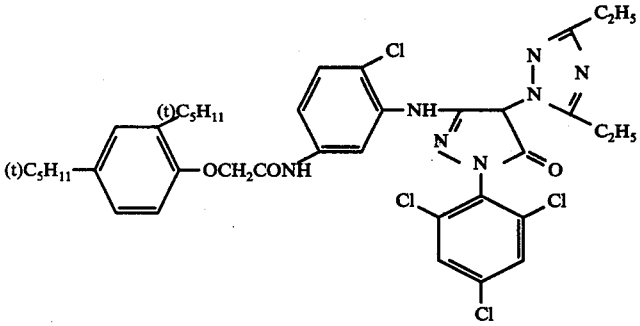
(15)
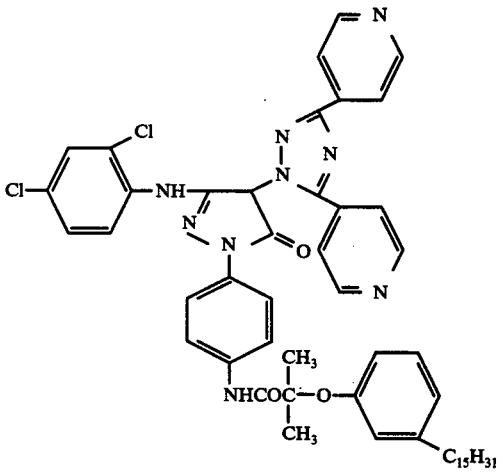
(16)
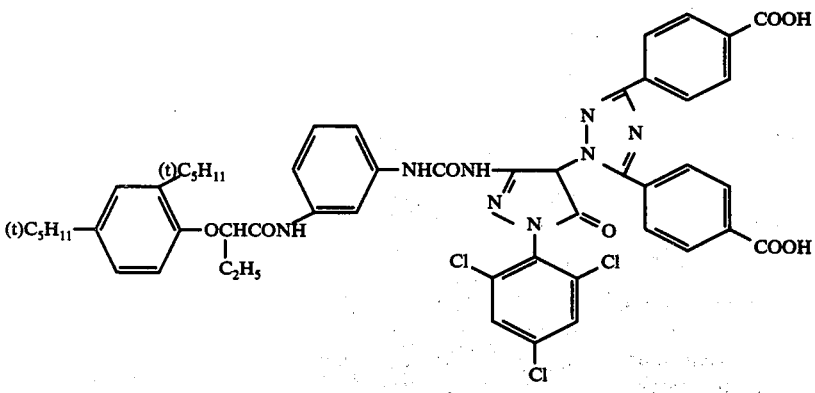

-continued (17)

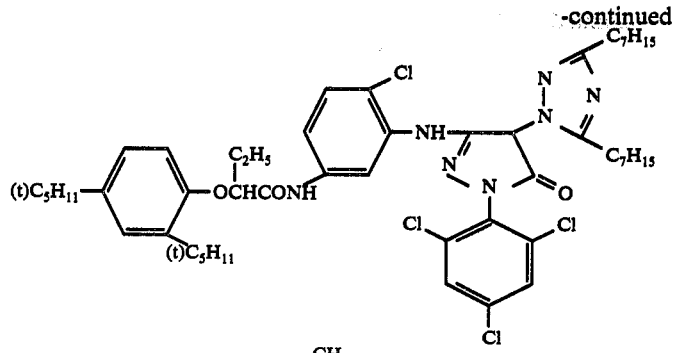

(18)

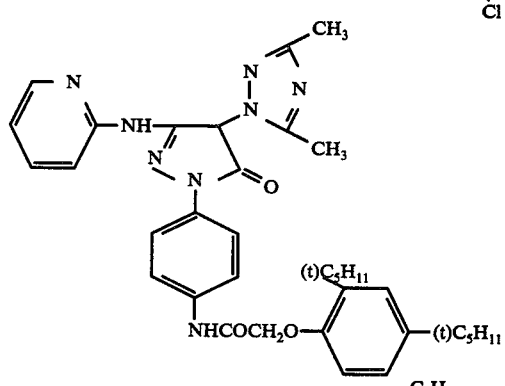

(19)

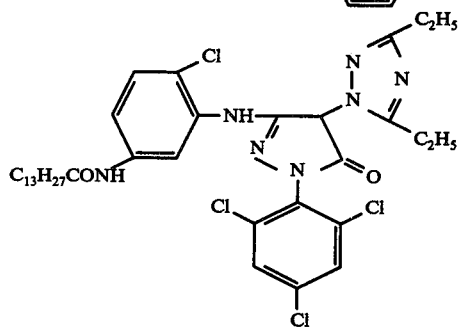

(20)

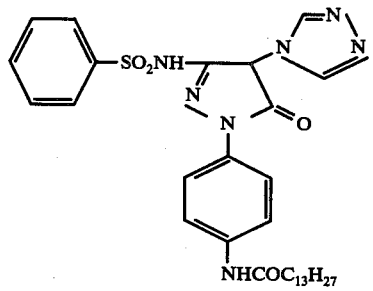

The magenta coupler of the present invention can be generally prepared by reacting a magenta coupler having a halogen atom, preferably a bromine atom, at the coupling position with a 1,2,4-triazole compound.

The magenta coupler having a halogen atom at the coupling position which is a starting material for preparing the magenta coupler of the present invention can be easily prepared by the method described, for example, in U.S. Pat. No. 3,006,759, British Pat. No. 1,141,391, etc.

The various 1,2,4-triazole compounds are easily available since methods for preparation thereof are well known and some of these compounds are commercially available.

The reaction of a 4-bromo-5-oxo-2-pyrazoline with a 1,2,4-triazole can be carried out by heating in the absence of a solvent or in the presence of a solvent in an amount of less than a total weight of the starting materials, at a temperature range of about 50° to 200° C, preferably 95° to 140° C, the 4-bromo-5-oxo-2-pyrazoline together with the 1,2,4-triazole in a molar ratio of about 2:1 to 5:1 to the 1,2,4-triazole. Suitable preferred solvents include an aprotic polar solvent, for example, an aromatic hydrocarbon such as benzene, toluene, etc., an ether such as tetrahydrofuran (THF), dioxane, etc., a acetonitrile, dimethylformamide (DMF), dimethylsulfoxide (DMSO), N-methylpyrrolidone (NMP), hexamethylphosphorictriamide (HMPA), and the like.

Other magenta couplers than the 5-oxo-2-pyrazolines such as pyrazolobenzimidazoles can be prepared in a similar manner.

Typical synthesis examples of the magneta couplers of the present invention are illustrated below.

SYNTHESIS EXAMPLE 1

Preparation of
1-(2,4,6-Trichlorophenyl)-3-{3-[(2,4-di-tert-phenylphenoxy)acetamido]benzamido}-4-(3,5-diethyl-1-triazolyl)-5-oxo-2-pyrazoline [Coupler (4)]

A mixture of 15.0 g of 1-(2,4,6-trichlorophenyl)-3-{3-[(2,4-di-tert-phentylphenoxy)acetamido]benzamido}-4-bromo-5-oxo-2-pyrazoline (which was prepared according to the method described in U.S. Pat. No. 3,006,759), 10.0 g of 3,5-diethyl-1,2,4-triazole and 10 ml of -hexamethylphosphorictriamide (HMPA) was heated and stirred for 6 hours at 100° C. After the reaction, 200 ml of ethyl acetate was added to the reaction system to form a solution and the solution was extracted once with 200 ml of 2N hydrochloric acid. The organic solvent layer was washed with water until it showed a pH of about 7. The organic solvent layer was dried with sodium sulfate and condensed. The residue was recrystallized from a solvent mixture of acetonitrile and ethyl acetae (2:1 by volume) to yield 5.1 g of Coupler (4). The melting point was 195° to 198° C.

Elemental Analysis — Calculated for $C_{40}H_{46}N_7O_4Cl_3$: H: 5.83%, C:60.41%, N:12.33%; Found: H:5.98%, C:60.19%, N: 12.08%.

SYNETHESIS EXAMPLE 2

Preparation of
1-(2,4,6-Trichlorophenyl)-3-(2-chloro-5-tetradecanamdio)anilino-4-(3,5-diethyl-1-triazolyl)-5-oxo-2-pyrazoline [Coupler (19)]

A mixture of 22.0 g of 1-(2,4,6-trichlorophenyl-3-[N-acetyl-(2-chloro-5-tetradecanamido)anilino]-4-bromo-5-oxo-2-pyrazoline, 12.0 g of 3,5-diethyl-1,2,4-triazole and 10 ml of HMPA was heated and stirred at 110° C for 8 hours. After the reaction, 300 ml of ethyl acetate was added to the reaction system to form a solution and the solution was extracted once with 200 ml of 2N hydrochloric acid. The organic solvent layer was washed with water until it showed a pH of about 7. The organic solvent layer was dried with sodium sulfate and condensed. The residue was recrystallized from a solvent mixture of acetonitrile and ethyl acetate (1:1 by volume) to yield 15.5 g of 1-(2,4,6-trichlorophenyl)-3-[N-acetyl-(2-chloro-5-tetradecanamido)anilino]-4-(3,5-diethyl-1-triazolyl)-5-oxo-2-pyrazoline having a melting point of 240° to 242° C.

The compound was dissolved in 200 ml of a 7.5% methanol solution of potassium hydroxide and allowed to stand at room temperature for 1 day. The solution was poured into 1 liter of water and upon neutralization with hydrochloric acid, crystals were precipitated. The crystals were collected by filtration and recrystallized from acetonitrile to yield 12.1 g of Coupler (19). The melting point was 225° to 226° C.

Elemental Analysis — Calculated for $C_{35}H_{45}N_5O_2Cl_4$: H: 6.15%, C:56.99%, N:13.29%; Found: H:6.15%, C:56.68%, N:13.17%.

In order to produce silver halide color photographic light-sensitive materials using the couplers of the present invention, the couplers can be used individually or two or more of the couplers can be used as a mixture.

In color photographic light-sensitive materials containing the couplers of the present invention, other couplers, for example, a cyan dye forming coupler such as those described in U.S. Pat. Nos. 2,474,293, 3,034,892, 3,591,383, 3,311,476 and 3,476,563, etc., a compound which releases a development inhibitor upon color developer (a so-called DIR coupler and DIR compound) such as those described in U.S. Pat. Nos. 3,632,345, 3,227,554, 3,379,529, etc., a yellow dye forming coupler, such as those described in German Patent Application (OLS) No. 2,213,461, U.S. Pat. No. 3,510,306, etc., and a magenta dye forming coupler other than the magenta coupler o the present invention such as those described in U.S. Pat. No. 3,615,506, German Patent Application (OLS) Nos. 2,418,959 and 2,424,467, etc., can be employed.

The silver halide emulsion which can be used in the present invention includes those of silver chloride and silver bromide and also a mixed silver halide such as silver chlorobromide, silver iodobromide, silver chloroiodobromide, etc.

The silver halide emulsion can be produced using known conventional methods, for example, a single or double jet method, a controlled double jet method, etc.

Furthermore, silver halide grains wherein latent images are formed in the surface portion thereof or those wherein latent images are formed in the interior portion thereof can be used.

The silver halide emulsion is preferably sensitized with a known chemical sensitizer, for example, sodium thiosulfate, N,N,N' -trimethyl thiourea, aurous thiocyante complex salt, aurous thiosulfate complex salt, stannous chloride, hexamethylene-tetramine, etc.

The silver halide grains can be fogged with a reducing agent such as hydrazine or a combination of a reducing agent and a gold compound or a labile sulfur compound.

The photographic emulsion used in the color photographic light-sensitive material according to the present invention can be spectrally sensitized to be sensitive to blue, green or red light using a cyanine dye such as a cyanine, merocyanine or carbocyanine dye, individually or in combination, or using a combination of these dyes and a styryl dye, amino stilbene compund or the like, if desired.

Known stabilizing agents and anti-fogging agents, for example, 4-hydroxy-6-methyl-1,3,3a,7-tetrazaindene, 3-methylbenzothiazole, 1-phenyl-5-mercaptotetrazole, a mercapto compound, a metal salt, etc., can be used in the photographic emulsion.

The formation of dye images with the coupler of the present invention can be achieved with various kinds of color photographic processing systems. One process comprises processing an image-wise exposed silver halide light-sensitive material with a color developer solution containing an aromatic primary amine color developing agent in which a coupler is dissolved to form a water-insluble or diffusion resistant dye image in the emulsion layer, that is, a coupler-in-developer type color process. Another process comprises processing an image-wise exposed light-sensitive material having a silver halide emulsion layer containing a diffusion resistant coupler with a color developer solution containing an aromatic primary amine color developing agent to form a water-insoluble or diffusion resistant dye image in the emulsion layer. Still another process comprises processing an image-wise exposed light-sensitive photographic material having a silver halide emulsion layer in combination with a diffusion resistant coupler with an alkaline developer solution containing an aromatic primary amine color developing agent to form a diffusible dye which diffuses into an image receiving layer containing a hydrophilic colloid, that is, a diffusion transfer process.

Of the couplers of the present invention, for example, Coupler (7) can be used in the first process, Coupler (11) can be used with the third process and the remaining couplers illustrated above can be used in the second process.

The couplers of the present invention can be dispersed in the photographic emulsion after dissolving them in an aqueous medium or an organic solvent.

Of the couplers of the present invention, oil-soluble diffusion resistant couplers which are suitble for use in a coupler-in-emulsion type system are advantgeously dispersed in a photographic emulsion as a solution in an organic solvent. Specific examples of the process for dispersing the coupler are described in detail in U.s. Pat. No. 3,676,131. Suitable organic solvents for dissolving the coupler are those which are slightly soluble in water and hve a high boiling point and including, for example, a substituted hydrocarbon, a carboxylic acid ester, a benzoic acid ester, a citric acid ester, a carboxylic acid amide and a phosphoric acid ester. Specific examples of such compounds are di-n-butyl phthalate, n-octyl benzoate, o-acetyltributyl citrate, tricresylphosphate, tri-n-hexylphosphate, N,N-diethylcaprylamide, and the like. In addition to these high boiling point solvents, it is advantageous to use an auxiliary solvent having a low boiling point in order to assist the dissolution of the couplers. Examples of such compounds are propylene carbonate, ethyl acetate, butyl acetate, cyclohexanol, tetrahydrofuran, cyclohexanone, etc.

It is advantageous to use a surface active agent to aid in finely dispersing the solvents in a hydrophilic colloid used for a photographic emulsion. Diffusion resistant couplers having a carboxylic acid group or a sulfonic acid group together with a ballast group in the molecule are soluble in a neutral or weakly alkaline aqueous solution. The aqueous solution can be added to a photographic emulsion.

The coupler of this invention is generally incorporated into the light-sensitive material in the amount of about 10 to about 1,500 g per mol of silver halide and employed in a developer solution in an amount of about 0.2 to about 50 g/l, preferably 0.5 to 10 g/l. However, the amount can be varied depending on the purpose of use.

The coupler of the present invention can be employed in various silver halide light-sensitive materials, for example, color negative films, color positive films, color reversal films, color papers, and various other color light-sensitive materials. In addition, the coupler can be employed in color direct positive light-sensitive materials, instant color light-sensitive materials such as those for a color diffusion transfer process, etc.

The coupler of the present invention can be used in a known multilayer structure of a multilayer color light-sensitive material, for example, those described in U.S. Pat. Nos. 3,726,681 and 3,516,831, British Pat. Nos. 818,687 and 923,045, a method described in Japanese Patent Application No. 5179/1975, and a method in which the coupler is used together with a DIR compound as described in German Patent Application (OLS) No. 2,322,1655 and U.S. Pat. No. 3,703,375.

To increase the stability of the color photographic images formed it is advantageous for the light-sensitive material used in the present invention to contain a p-substituted phenol derivative, e.g., a hydroquinone derivatives, in an emulsion layer thereof or an adjacent layer thereto. Particularly preferred p-substituted phenol derivatives are those described in U.S. Pat. Nos. 2,360,290, 2,418,613, 2,675,314, 2,710,801, 2,728,659, 2,732,300, 2,735,765, 2,816,028, 3,457,079 and 3,069,262, Japanese Patent Publication No. 13496/1968, U.S. Pat. No. 2,735,765, Japanese Patent Application (OPI) No. 4738/1972, U.S. Pat. Nos. 3,432,300, 3,573,050, 3,574,627 and 3,764,337.

The light-sensitive material containing the coupler of the present invention can contain an ultraviolet absorbing agent as described, for example, in U.S. Pat. Nos. 3,250,617 and 3,253,921 in an emulsion layer or an adjacent layer thereto so as to stabilize the images formed.

The support for the color light-sensitive material of the present invention is a cellulose acetate film, a cellulose acetate butyrate film, a polystyrene film, a polyethylene terephthalate film, a laminate of these films, a glass, a paper, a baryta paper, a paper coated or laminated with baryta or a polymer of an $\alpha$-olefin having 2 to 10 carbon atoms, such as polyethylene, polypropylene, an ethylene-butene copolymer, etc. A suitable coating amount of silver halide per unit area of the support is about $1 \times 10^{-4}$ to about $10^{-2}$ mol/m$^2$.

The photographic light-sensitive material containing the coupler of the present invention can be usually processed, after exposure, in a known method including basically a color development step, a bleaching step and a fixing step. Each step can be conducted separately or two or more steps can be carried out as one step using a processing solution which has the capability of performing each of these steps. For example, the use of a bleach-fixing solution is one example of such a combination. If desired, the processing can include other steps such as a prehardening, a neutralization, a first development (black-and-white development), an image stabilizing, a water washing, etc.

The processing temperature used sometimes is below about 18° C but often advantageously is above about 18° C. In particular, the temprature generally ranges from about 20° to about 60° C.

A color developer solution is an alkaline aqueous solution having a pH of 8 or above, and particularly 9 to 12, which contains a color deeloping agent.

Preferred examples of the above described color developing agents are 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 4-amino-3-methyl-N-ethyl-N-$\beta$-methanesulfonamidoethylaniline, 4-amino-3-methyl-N-ethyl-N-$\beta$-methoxyethylaniline, etc. In addition, the compounds described in U.S. Pat. Nos. 2,193,015 and 2,592,364, Japanese Patent Application (OPI) No. 64933/1973 and L. F. A. Mason, *Photographic Processing Chemistry,* pages 226 to 229, Focal Press, London (1966), can be also used.

The light-sensitive material containing the coupler of the present invention can be carried out in a color development step even in the presence of a competing coupler without practical damage.

After the color development step, the light-sensitive material of the present invention is subjected to a bleaching in a conventional manner. The bleaching can be carried out separately or simultaneously with fixing. In the latter case, a fixing agent is added to a bleaching solution to make a bleach-fixing bath. Many compounds can be used as a bleaching agent. For example, a ferricyanide, a bichromate, a complex salt of a polyvalent metal cation such as iron (III), cobalt (III), etc., and an organic acid, for example, a metal complex salt of an aminopolycarboxylic acid such as ethylenediamine tetraacetic acid, nitrilotriacetic acid, diaminopropanol tetraacetic acid, etc., citric acid, tartaric acid, malic acid, etc., can be used. It is possible to add to this processing solution a bleaching accelerating agent as described in U.S. Pat. Nos. 3,042,520 and 3,241,966, Japanese Patent Publication Nos. 8506/1970 and 8836/1970, etc., and various other additives.

The coupler of the present invention can be used for light-sensitive materials having a low silver content wherein the amount of silver halide in the emulsion is from about one half to about one hundredth of that in conventional light-sensitive materials. It is possible to obtain a satisfactory color image in such color light-sensitive materials having a low silver halide content by applying an image forming process which comprises a color intensification using a peroxide, a cobalt complex salt or sodium chlorite, for example, as described in German Patent Application (OLS) No. 2,357,694, U.S. Pat. Nos. 3,674,490 and 3,761,265, German Patent Apoplication (OLS) Nos. 2,044,833, 2,056,359, 2,056,360, 2,226,770, Japanese Patent Application (OPI) Nos. 9728/1973 and 9729/1973, etc.

Valuable results are obtained according to the present invention, some of which are described below.

1. The amount of silver required to provide a certain magenta color image density can be reduced and, thus, it leads to the ability to reduce the thickness of the light-sensitive layer containing the coupler and improving the sharpness of the image.

2. A reduction of the production cost of the light-sensitive material is achieved by using a reduced amount of silver halide.

3. The heat resistance of the magenta color image formed is improved by using the coupler of the present invention.

4. Magenta couplers which are more stable to chemical compounds such as formaldehyde or acetone are provided.

5. A high developing reactivity are provided by the couplers of this invention.

6. A color image having a lesser degree of fog and stain is obtained.

7. A silver halide color photographic light-sensitive material having good stability under storage is obtained by using the coupler of the present invention.

8. The conversion yield into the dye is improved by using the coupler of the present invention.

9. A color image free from silver is obtained by using the coupler of the present invention.

The present invention will be further illustrated by reference to the following examples. However, the present invention is not to be construed as being limited to these examples.

EXAMPLE 1

A mixture of 22.2 g of the above-described Coupler (4) of the present invention, 24 ml of dioctyl butyl phosphate and 60 ml of ethyl acetate was heated to 60° C and the resulting solution was added to 250 ml of an aqueous solution at 60° C containing 25 g of gelatin and 0.75 g of sodium dodecylbenzenesulfonate, followed by vigorous mechanical stirring using a homogenizer, thus obtaining a coupler dispersion. The resulting coupler dispersion was mixed with 200 g of a photographic emulsion containing $11.2 \times 10^{-2}$ mol of silver chlorobromide (silver bromide: 45 mol%; silver chloride: 55 mol%) and 20 g of gelatin and, after 10 ml of a 3% acetone solution of triethylenephosphoramide as a hardener was added thereto, the final pH was adjusted to 6.5. The mixture was coated onto a cellulose triacetate film support to give a dry thickness of 4.5 $\mu$ (Film A). This film contained, per $m^2$, $1.55 \times 10^{-3}$ mol of the coupler and $6.2 \times 10^{-3}$ mol of silver chlorobromide.

For comparision, 18.8 g of 1-(2,4,6-trichlorophenyl)-3-{3-(2,4-di-tert-pentylphenoxy)acetamido]benzamido}-5-oxo-2-pyrazoline (Coupler K), as a corresponding comparision coupler in which the coupling position was not substituted, was dispersed, in place of the above-described coupler in a manner analogous to the above-described coupler, mixed with 400 g of the same emulsion as described above and coated onto a film to give a dry thickness of 5.1 $\mu$ (Film B). This film contained, per $m^2$, $1.57 \times 10^{-3}$ mol of the coupler and $12.6 \times 10^{-3}$ mol of silver chlorobromide.

These films were subjected to stepwise exposure and then to the following processing.

| | Temperature (° C) | Time |
|---|---|---|
| 1. Color Development | 21 | 12 min |
| 2. Water Washing | " | 30 sec |
| 3. First Fixing | " | 4 min |
| 4. Water Washing | " | 4 min |
| 5. Bleaching | " | 8 min |
| 6. Water Washing | " | 4 min |
| 7. Second Fixing | " | 4 min |
| 8. Water Washing | " | 6 min |
| Color Developer Solution | | (pH 10.7) |
| Sodium Hexametaphosphate | 2 | g |
| Sodium Sulfite (anhydrous) | 2 | g |
| Benzyl Alcohol | 5 | ml |
| Sodium Carbonate (monohydrate) | 27.5 | g |
| Potassium Bromide | 0.5 | g |
| Hydroxylamine Sulfate | 2.5 | g |
| N-Ethyl-N-(β-methanesulfonamidoethyl)-3-methyl-4-aminoaniline Sesquisulfate | 2.5 | g |
| Water to make | 1 | l |
| Fixing Solution | | (pH 4.5) |
| Sodium Thiosulfate (hexahydrate) | 80 | g |
| Sodium Sulfite (anhydrous) | 5 | g |
| Borax | 6 | g |
| Acetic Acid (glacial) | 4 | ml |
| Potassium Alum | 7 | g |
| Water to make | 1 | l |
| Bleaching Solution | | (pH 7.2) |
| Potassium Ferricyanide | 100 | g |
| Potassium Bromide | 5 | g |
| Boric Acid | 10 | g |
| Borax | 5 | g |
| Water to make | 1 | l |

After the processings, these films were subjected to measurement of the optical density with green light to obtain the photographic properties as shown in Table 1. A clear color image was obtained having an absorption maximum of 542 mμ.

TABLE 1

| | | Photographic Properties | | | | | | | |
|---|---|---|---|---|---|---|---|---|---|
| | | Coating Amount (mol/m²) | | AgX/ Coupler (molar | | | | | Max- |
| Film | Coupler | Coupler | AgX | ratio) | Thick- ness | Fog | Gamma | Relative Sensi- tivity* | imum Color Density |
| A | (4) | $1.55 \times 10^{-3}$ | $6.2 \times 10^{-3}$ | 4 | 4.5 | 0.03 | 2.63 | 100 | 3.10 |

TABLE 1-continued

| Film | Coupler | Coating Amount (mol/m²) Coupler | Coating Amount (mol/m²) AgX | AgX/Coupler (molar ratio) | Thickness | Fog | Gamma | Relative Sensitivity* | Maximum Color Density |
|---|---|---|---|---|---|---|---|---|---|
| | | Photographic Properties | | | | | | | |
| B | K | $1.57 \times 10^{-3}$ | $12.6 \times 10^{-3}$ | 8 | 5.1 | 0.02 | 2.18 | 97 | 2.42 |

*Relative sensitivity means the quantity of exposure necessary for obtaining a density of fog +0.1.

As is evident from the results in Table 1, the coupler of the present invention provided a higher sensitivity and gradation as well as a maximum color density, even when the ratio of silver halide/coupler was decreased to about 1/2. The above results exhibit that in using the coupler of the present invention, the quantity of developed silver necessary for obtaining a color image having a certain density can be reduced. That is, the quantities of the coupler and coated silver halide necessary for obtaining a certain maximum color density can be reduced and thus the developing time for obtaining images having desired characteristics can be shortened.

EXAMPLE 2

When the above-described Coupler (5) and Coupler (10) were used respectively in place of Coupler (4) in Example 1, similar results were obtained.

EXAMPLE 3

Using Film A and Film B as shown in Example 1, after exposure, the following processing was carried out.

| Color Developing Step | Temperature (° C) | Time (min) |
|---|---|---|
| 1. Color Development | 30 | 4 |
| 2. Blixing | " | 2 |
| 3. Water Washing | " | " |
| 4. Stabilizing Bath | " | " |
| Color Developer Solution | | (pH 10.2) |
| Sodium Metaborate | | 25 g |
| Sodium Sulfite | | 2 g |
| Hydroxylamine (sulfate) | | 2 g |
| Potassium Bromide | | 0.5 g |
| 6-Nitrobenzimidazole (nitrate) | | 0.02 g |
| Sodium Hydroxide | | 4 g |
| Benzyl Alcohol | | 15.8 ml |
| Diethylene Glycol | | 20 ml |
| 4-(N-Ethyl-N-β-methanesulfonamidoethyl)-amino-2-methylaniline Sesquisulfate | | 8 g |
| Water to make | | 1 l |
| Blixing Solution | | (pH 6.9) |
| Ferric Ethylenediaminetetraacetate | | 45 g |
| Ammonium Thiocyanate | | 10 g |
| Sodium Sulfite | | 10 g |
| Ammonium Thiosulfate (60% aq. soln.) | | 100 ml |
| Sodium Ethylenediaminetetraacetate | | 5 g |
| Water to make | | 1 l |
| Stabilizing Bath (a) | | |
| Tartaric Acid | | 10 g |
| Zinc Sulfate | | 10 g |
| Sodium Metaborate | | 20 g |
| Water to make | | 1 l |
| Stabilizing Bath (b) | | |
| Tartaric Acid | | 10 g |
| Zinc Sulfate | | 10 g |
| Sodium Metaborate | | 20 g |
| Formaldehyde (40% aq. soln.) | | 10 ml |
| Water to make | | 1 l |

The photographic properties of the thus-obtained films are shown in Table 2.

Moreover, as to the Stabilizing Bath, two kinds of stabilizing baths, i.e., Stabilizing Bath (a) containing no formaldehyde and Stabilizing Bath (b) containing 1% of a 40% aqueous solution of formaldehyde were prepared. The films were treated respectively with these baths, allowed to stand at 80° C for 1 week and the ratio of the density decrease to the initial density was measured and the results are illustrated in Table 3.

TABLE 2

| Film | Coupler | Photographic Properties (Stabilizing Bath (a)) Fog | Gamma | Maximum Color Density |
|---|---|---|---|---|
| A | (4) | 0.04 | 2.79 | 3.10 |
| B | K | 0.03 | 2.13 | 2.41 |

TABLE 3

| Film | Stabilizing Bath | Durability of Color Image (%) (80° C, standing for one week) Initial Density 0.5 | 1.0 | 2.0 |
|---|---|---|---|---|
| A | a | 10% | 8% | 6% |
| A | b | 9% | 8% | 5% |
| B | a | 52% | 34% | 10% |
| B | b | 11% | 8% | 5% |

The results in Table 2 show that the use of Film A results in a sufficient photographic property even though a strong oxidizer (potassium ferricyanide) is not used as in the processing of Example 1 and that Film A has superior photographic properties to Film B containing a four-equivalent coupler. The results in Table 3 show that Film A has sufficient heat durability even though such was not subjected to a stabilizing bath treatment containing formaldehyde.

EXAMPLE 4

When the samples described in Example 2 were treated in the same manner as described in Example 3, similar results were obtained.

EXAMPLE 5

Onto a paper support resin-coated with polyethylene were coated, as a first layer, a blue-sensitive silver chlorobromide emulsion containing α-pivaloyl-α-(2,4-dioxo-5,5-dimethyloxazolidin-3-yl)-2-chloro-5-[α-(2,4-di-tert-pentylphenoxy)butyramido]-acetanilide in a dry thickness of 3.0 μ (coupler coated amount: $1.18 \times 10^{-3}$ mol/m²; silver coated amount: $3.53 \times 10^{-3}$ mol/m²; silver bromide: 70 mol%; silver chloride: 30 mol%) and further, as a second layer, a gelatin containing 2-tert-octylhydroquinone in a dry thickness of 1.5 μ (hydroquinone compound coated amount: 0.05 g/m²).

A mixture of 8.5 g of the above-described Coupler (19) of the present invention, 0.8 g of 2,5-di-tert-octylhydroquinone, 0.8 g of 6,6'-dihydroxy-7,7'-dimethyl-4,4,4',4'-tetramethylbis-2,2'-spirochroman, 10 ml of tricresyl phosphate and 30 ml of ethyl acetate was heated and dissolved on a steam bath and added to an aqueous solution containing 10 g of gelatin and 0.5 g of sodium cetylsulfate, followed by vigorous mechanical stirring, thus obtaining a coupler dispersion. This coupler dispersion was mixed with 100 g of a photographic emulsion containing $4.7 \times 10^{-2}$ mol of silver chlorobromide (silver chloride: 50 mol%; silver bromide: 50 mol%) and 9 g of gelatin, to which 3 ml of a 4% aqueous solution of 2-hydroxy-4,6-dichloro-s-triazine sodium salt as a hardener was then added, and the pH was adjusted to 6.3. The resulting mixture was coated in a dry thickness of 1.9 $\mu$ as a third layer (coupler coated amount: $4.7 \times 10^{-4}$ mol/m$^2$; silver coated amount: $1.88 \times 10^{-3}$ mol/m$^2$).

Then a gelatin containing 2,5-di-tert-octylhydroquinone and as a ultraviolet absorber, 2-(5-chlorobenzotriazol-2-yl)-4-methyl-6-tert-butylphenol and 2-(benzotriazol-2-yl)-4-tert-butylphenol was coated in a dry thickness of 2.5 $\mu$ as a fourth layer (hydroquinone compound coated amount: 0.05 g/m$^2$; benzotriazole compound coated amount: 0.4 g/m$^2$, each), a red-sensitive emulsion containing 2-[$\alpha$-(2,4-di-tert-pentylphenoxy)-butyramido]-4,6-dichloro-5-methylphenol was coated in a dry thickness of 2.5 $\mu$ as a fifth layer (coupler coated amount: $0.98 \times 10^{-3}$ mol/m$^2$; silver coated amount $2.94 \times 10^{-3}$ mol/m$^2$; silver bromide 50 mol%; silver chloride 50 mol%) and gelatin was then coated in a dry thickness of 1.0 $\mu$ as an uppermost layer, thus preparing a color print paper (Film C).

For comparison, another coupler dispersion was prepared in the same manner as described above but using 7.2 g of a 4-position unsubstituted corresponding comparison coupler, i.e., 1-(2,4,6-trichlorophenyl)-3-(2-chloro-5-tetradecanamido)anilino-5-oxo-2-pyrazoline (Coupler L), in place of Coupler (19) in the third layer of Film C, mixed with 200 g of the emulsion having the same composition and coated to give a dry thickness of 3.0 $\mu$ as a third layer and thus another color print paper was prepared (Film D). In the third layer, $7.5 \times 10^{-4}$ mol of the coupler and $6.0 \times 10^{-3}$ mol of the silver halide were coated per m$^2$.

When these samples were subjected to stepwise exposure and processing (Stabilizing Bath (a)) similar to Example 2 and the reflection density was measured with green light, the photographic properties as shown in Table 4 were obtained. A clear color image of a main wavelength of 541 nm was obtained.

TABLE 4

| Film | Coupler | Photographic Properties: Coating Amount (mol/m$^2$) Coupler | AgX | AgX/Coupler (molar ratio) | Fog | Gamma | Relative Sensitivity | Maximum Color Density |
|---|---|---|---|---|---|---|---|---|
| C | (19) | $4.7 \times 10^{-4}$ | $1.88 \times 10^{-3}$ | 4 | 0.06 | 2.35 | 100 | 2.32 |
| D | L | $7.5 \times 10^{-4}$ | $6.0 \times 10^{-3}$ | 8 | 0.05 | 2.34 | 98 | 2.29 |

It is apparent from the results in Table 4 that the light-sensitive material using the coupler of the present invention provides similar photographic properties to those of the prior art even though the coating amounts of the coupler and silver halide are reduced.

In Table 5, the light-durability when the thus-obtained developed films were exposed to a day-light type fluorescent lamp of 30,000 luxes through a filter capable of absorbing substantially all ultraviolet rays having a wavelength of 400 nm or less for 12 days, the heat durability when these films were allowed to stand at 80° C in the dark for 1 week and the humidity durability when these films were stored in the dark at 60° C and 75% RH (Relative Humidity) for 2 weeks are shown by the ratio of decreasing density (%) based on the initial density.

TABLE 5

| Film | Coupler | Durability of Color Image (Density Decreasing Ratio %): Fluorescent Lamp 12 Days Initial Density 0.5 | 1.0 | 2.0 | 80° C, 1 Week Initial Density 0.5 | 1.0 | 2.0 | 60° C, 75% RH 2 Weeks Initial Density 0.5 | 1.0 | 2.0 |
|---|---|---|---|---|---|---|---|---|---|---|
| C | (19) | 14 | 7 | 4 | 10 | 5 | 3 | 6 | 4 | 2 |
| D | L | 21 | 13 | 6 | 25 | 15 | 5 | 15 | 9 | 5 |

It is apparent from these results in Table 5 that in using the coupler of the present invention, an image can be obtained which is durable to heat, humidity and light.

EXAMPLE 6

When the above-described Coupler (8) and Coupler (14) were used respectively in place of Coupler (19) in Example 5, similar results were obtained.

While the invention has been described in detail and with reference to specific embodiments thereof, it will be apparent to one skilled in the art that various changes and modifications can be made therein without departing from the spirit and scope thereof.

What is claimed is:

1. A photographic silver halide emulsion containing a photographic coupler represented by the following general formula (I) or (II):

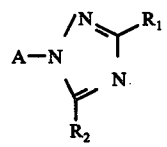

(I)

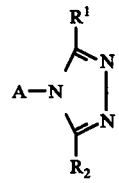

(II)

wherein $R_1$ and $R_2$, which may be the same or different, each represents a hydrogen atom, an alkyl group, an aryl group, an aralkyl group, a heterocyclic group, an amino group, an alkylamino group, an acylamino group, a sulfonamido group, a ureido group, a thioureido group, a urethane group, a thiourethane group, a carbamoyl group, a thiocarbamoyl group, an alkoxycarbonyl group, an aryloxycarbonyl group, a carboxy group, an alkylcarbonyl group or an arylcarbonyl group and A represents a magenta coupler residue of the following general formula (III):

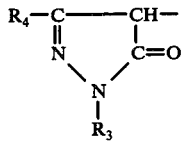

wherein $R_3$ has up to 40 carbon atoms and is selected from the group consisting of a straight chain or branched chain alkyl group, an alkenyl group, a cycloalkyl group, an aralkyl group and a cycloalkenyl group, in which each of these groups can be substituted with one or more of a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group; an unsubstituted aryl group, an aryl group substituted with one or more of a halogen atom, an alkyl group, an alkenyl group, a cycloalkyl group, an aralkyl group, a cycloalkenyl group, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group and a mercapto group; an unsubstituted heterocyclic group, a heterocyclic group substituted with one or more of the substituents above described for the aryl group; an aliphatic or aromatic acyl group; an alkylsulfonyl group; an arylsulfonyl group; an alkylcarbamoyl group; an arylcarbamoyl group; an alkylthiocarbamoyl group; or an aryl thiocarbamoyl group;

$R_4$ has up to 40 carbon atoms and is selected from the group consisting of a hydrogen atom, a straight chain or branched chain alkyl group, an alkenyl group, a cycloalkyl group, an aralkyl group, a cycloalkenyl group, an aryl group, a heterocyclic group, in which each of these groups can be substituted with one or more of the substituents above described for $R_3$; an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, a ureido group, a urethane group, a thiourethane group, an arylamino group, an alkylamino group, a cycloamino group, a heterocyclic amino group, an alkylcarbonyl group, an arylcarbonyl group, a sulfonamido group, a carbamoyl group, a sulfamoyl group, a cyano group, a hydroxy group, a mercapto group, a halogen atom or a sulfo group.

2. The photographic silver halide emulsion as claimed in claim 1, wherein $R_3$ is a phenyl group in which at least one of the ortho positions is substituted with an alkyl group, an alkoxy group or a halogen atom.

3. The photographic silver halide emulsion as claimed in claim 1, wherein said coupler is represented by the following general formula (V):

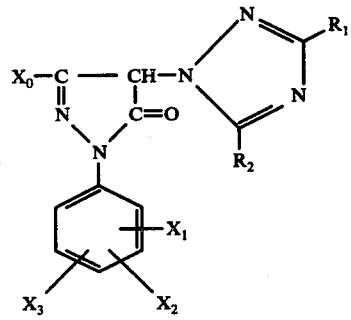

(V)

wherein $R_1$ and $R_2$ each has the same meaning as defined in claim 2;

$X_0$ represents an alkyl group, an alkoxy group, an acylamino group, a ureido group or a phenylamino group; and $X_1$, $X_2$ and $X_3$, which may be the same or different, each represents a hydrogen atom, a halogen atom, an alkyl group, a sulfo group, an aryloxy group, an acylamino group, an alkoxy group, or an amido group.

4. A photographic light-sensitive material comprising a support having thereon a layer of the photographic silver halide emulsion as claimed in claim 1.

5. The photographic light-sensitive material as claimed in claim 4, wherein said photographic silver halide emulsion layer is a green-sensitive silver halide emulsion layer and said photographic light-sensitive material additionally contains on said support a red-sensitive silver halide emulsion layer, and a blue-sensitive silver halide emulsion layer.

6. A photographic silver halide emulsion containing a photographic coupler represented by the following general formula (I) or (II):

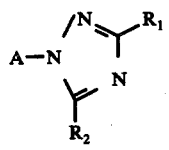

(I)

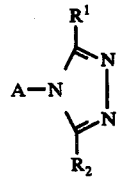

(II)

wherein $R_1$ and $R_2$, which may be the same or different, each represents a hydrogen atom, an alkyl group, an aryl group, an aralkyl group, a heterocyclic group, an amino group, an alkylamino group, an acylamino group, a sulfonamido group, a ureido group, a thioureido group, a urethane group, a thiourethane group, a carbamoyl group, a thiocarbamoyl group, an alkoxycarbonyl group, an aryloxycarbonyl group, a carboxy group, an alkylcarbonyl group or an arylcarbonyl group and A represents a magenta coupler residue of the following general formula (IV):

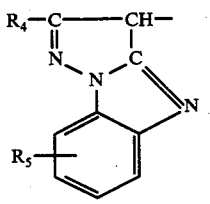

(IV)

wherein $R_4$ has up to 40 carbon atoms and is selected from the group consisting of a straight chain or branched chain alkyl group, an alkenyl group, a cycloalkyl group, an aralkyl group, a cycloalkenyl group, an aryl group, a heterocyclic group, in which each of these groups can be substituted with one or more of a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group; an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, a ureido group, a urethane group, a thiourethane group, an arylamino group, an alkylamino group, a cycloamino group, a heterocyclic amino group, an alkylcarbonyl group, an arylcarbonyl group, a sulfonamido group, a carbamoyl group, a sulfamoyl group, a cyano group, a hydroxy group; a mercapto group, a halogen atom or a sulfo group, and $R_5$ has up to 32 carbon atoms and is selected from the group consisting of a hydrogen atom, a straight chain or branched chain alkyl group, an alkenyl group, a cycloalkyl group, an aralkyl group, a cycloalkenyl group, an aryl group, a heterocyclic group, in which each of these groups can be substituted with one or more of a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group; a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-alkylanilino group, an N-arylanilino group, an N-acrylanilino group, a hydroxy group, or a mercapto group.

7. A photographic light-sensitive material comprising a support having thereon a layer of a photographic silver halide emulsion as claimed in claim 6.

8. The photographic light-sensitive material as claimed in claim 7, wherein said photographic silver halide emulsion is a green-sensitive silver halide emulsion layer and said photographic light-sensitive material additionally contains on said support a red-sensitive silver halide emulsion layer, and a blue-sensitive silver halide emulsion layer.

9. A photographic color developer solution containing a primary aromatic amine developing agent and a photographic coupler represented by the following general formula (I) or (II):

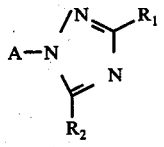

(I)

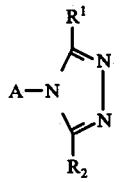

(II)

wherein $R_1$ and $R_2$, which may be the same or different, each represents a hydrogen atom, an alkyl group, an aryl group, an aralkyl group, a heterocyclic group, an amino group, an alkylamino group, an acylamino group, a sulfonamido group, a ureido group, a thioureido group, a urethane group, a thiourethane group, a carbamoyl group, a thiocarbamoyl group, an alkoxycarbonyl group, an aryloxycarbonyl group, a carboxy group, an alkylcarbonyl group or an arylcarbonyl group and A represents a magenta coupler residue of the following general formula (III):

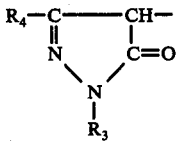

wherein $R_3$ has up to 40 carbon atoms and is selected from the group consisting of a straight chain or branched chain alkyl group, an alkenyl group, a cycloalkyl group, an aralkyl group and a cycloalkenyl group, in which each of these groups can be substituted with one or more of a halogen atom, a nitro group, a cyano group, an aryl group, an alkoxy group, an aryloxy group, a carboxyl group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group; an unsubstituted aryl group, an aryl group substituted with one or more of a halogen atom, a alkyl group, an alkenyl group, a cycloalkyl group, an aralkyl group, a cycloalkenyl group, a nitro group, a cyano group, an aryl, group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group and a mercapto group; an unsubstituted heterocyclic group, a heterocyclic group substituted with one or more of the substituents above described for the aryl group; an aliphatic or aromatic acyl group; an alkylsulfonyl group; an arylsulfonyl group; an alkylcarbamoyl group; an arylcarbamoyl group; an alkylthiocarbamoyl group; or an aryl thiocarbamoyl group;

$R_4$ has up to 40 carbon atoms and is selected from the group consisting of a hydrogen atom, a straight chain or branched chain alkyl group, an alkenyl group, a cycloalkyl group, an aralkyl group, a cycloalkenyl group, an aryl group, a heterocyclic group, in which each of these groups can be substituted with one or more of the substituents above described for $R_3$; an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, a ureido group, a urethane group, a thiourethane group, an arylamino group, an alkylamino group, a cycloamino group, a heterocyclic amino group, an alkylcarbonyl group, an arylcarbonyl group, a sulfonamido group, a carbamoyl group, a sulfamoyl group, a cyano group, a hydroxy group, a mercapto group, a halogen atom or a sulfo group.

10. A photographic color developer solution containing a primary aromatic amine developing agent and a photographic coupler represented by the following formula (I) or (II):

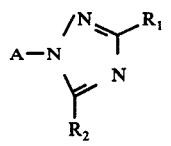

(I)

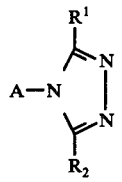

(II)

wherein $R_1$ and $R_2$, which may be the same or different, each represents a hydrogen atom, an alkyl group, an aryl group, an aralkyl group, a heterocyclic group, an amino group, an alkylamino group, an acylamino group, a sulfonamido group, a thioureido group, a urethane group, a thiourethane group, a carbamoyl group, a thiocarbamoyl group, an alkoxycarbonyl group, an aryloxycarbonyl group, a carboxy group, an alkylcarbonyl group or an arylcarbonyl group and A represents a magenta coupler residue of the following general formula (IV):

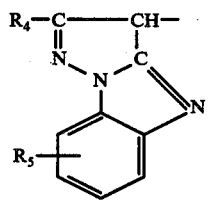

(IV)

wherein $R_4$ has up to 40 carbon atoms and is selected from the group consisting of a straight chain or branched chain alkyl group, an alkenyl group, a cycloalkyl group, an aralkyl group, a cycloalkenyl group, an aryl group, a heterocyclic group, in which each of these groups can be substituted with one or more of a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group; an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, a ureido group, a urethane group, a thiourethane group, an arylamino group, an alkylamino group, a cycloamino group, a heterocyclic amino group, an alkylcarbonyl group, an arylcarbonyl group, a sulfonamido group, a carbamoyl group, a sulfamoyl group, a cyano group, a hydroxy group; a mercapto group, a halogen atom or a sulfo group, and $R_5$ has up to 32 carbon atoms and is selected from the group consisting of a hydrogen atom, a straight chain or branched chain alkyl group, an alkenyl group, a cycloalkyl group, an aralkyl group, a cycloalkenyl group, an aryl group, a heterocyclic group, in which each of these groups can be substituted with one or more of a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group; a cyano group, an alkoxy group, an aryloxy group, a halogen atom, a carboxy group, an alkoxycarbonyl group, an aryloxycarbonyl group, an acyloxy group, a sulfo group, a sulfamoyl group, aa carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, or a mercapto group.

11. A method of forming images which comprises developing an image-wise exposed silver halide photographic light-sensitive material in the presence of a photographic coupler represented by the following general formula (I) or (II):

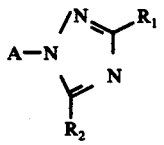

(I)

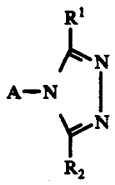

(II)

wherein $R_1$ and $R_2$, which may be the same or different, each represents a hydrogen atom, an alkyl group, an aryl group, an aralkyl group, a heterocyclic group, a amino group, an alkylamino group, an acylamino group, a sulfonamido group, a ureido group, a thioureido group, a urethane group, a thiourethane group, a carbamoyl group, a thiocarbamoyl group, an alkoxycarbony group, an aryloxycarbonyl group, a carboxy group, an alkylcarbonyl groupor an arylcarbonyl group and A represents a magenta coupler residue of the following general formula (III):

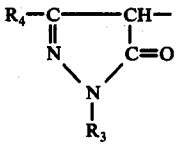

wherein $R_3$ has up to 40 carbon atoms and is selected from the group consisting of a straight chain or branched chain alkyl group, an alkenyl group, a cycloalkyl group, an aralkyl group and a cycloalkenyl group, in which each of these groups can be substituted with one or more of a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group; an unsubstituted aryl group, an aryl group substituted with one or more of a halogen atom, an alkyl group, an alkenyl group, a cycloalkyl group, an aralkyl group, a cycloalkenyl group, a nitro group, a cyano group, an aryl group, an alkoxy group, an aryloxy group a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonaido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group and a mercapto group; an unsubstituted heterocyclic group, a heterocyclic group substituted with one or more of the substituent above described for the aryl group; an aliphatic or aromatic acyl group; an alkylsulfonyl group; an arylsulfonyl group; an alkylcarbamoyl group; an arylcarbamoyl group; an alkylthiocarbamoyl group; or an aryl thiocarbamoyl group;

$R_4$ has up to 40 carbon atoms and is selected from the group consisting of a hydrogen atom, a straight chain or branched chain alkyl group, an alkenyl group, a cycloalkyl group, an aralkyl group, a cycloalkenyl group, an aryl group, a heterocyclic group, in which each of these groups can be substituted with one or more of the substituents above described for $R_3$; an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, a N-arylacylamino group, a ureido group, a urethane group, a thiourethane group, an arylamino group, an alkylamino group, a cycloamino group, a heterocyclic amino group, an alkylcarbonyl group, an arylcarbonyl group, a sulfonamido group, a carbamoyl group, a sulfamoyl group, a cyano group, a hydroxy group, a mercapto group, a halogen atom or a sulfo group.

12. A method of forming images which comprises developing an image-wise exposure silver halide photographic light-sensitive material in the presence of a photographic coupler represented by the following general formula (I) or (II):

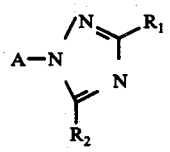

(I)

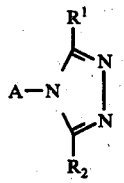

(II)

wherein $R_1$ and $R_2$, which may be the same or different, each represents a hydrogen atom, an alkyl group, an aryl group, an aralkyl group, a heterocyclic group, an amino group, an alkylamino group, an acylamino group, a sulfonamido group, a ureido group, a thioureido group, a urethane group, a thiourethane group, a carbamoyl group, a thiocarbamoyl group, an alkoxycarbonyl group, an aryloxycarbonyl group, a carboxy group, an alkylcarbonyl group or an arylcarbonyl group and A represents a magenta coupler residue of the following general formula (IV):

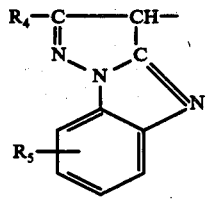

(IV)

wherein $R_4$ has up to 40 carbon atoms and is selected from the group consisting of a straight chain or branched chain akyl group, an alkenyl group, a cycloalkyl group, an aralkyl group, a cycloalkenyl group, an aryl group, a heterocyclic group, in which each of these groups can be substituted with one or more of a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group; an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, a ureido group, a urethane group, a thiourethane group, an arylamino group, an alkylamino group, a cycloamino group, a heterocyclic amino group, an alkylcarbonyl group, an arylcarbonyl group, a sulfonamido group, a carbamoyl group, a sulfamoyl group, a cyano group, a hydroxy group; a mercapto group, a halogen atom or a sulfo group, and $R_5$ has up to 32 carbon atoms and is selected from the group consisting of a hydrogen atom, a straight chain or branched chain alkyl group, an alkenyl group, a cycloalkyl group, an aralkyl group, a cycloalkenyl group, an aryl group, a heterocyclic group, in which each of these groups can be substituted with one or more of a halogen atom, a nitro group, a cyano group, an aryl group, an alkoxy group, an aryloxy group, a carboxy group, an alkylthicarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group; a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulonyl group, an arylthio group, an alkylthio group, an akylamino group, a dialkylamino group, an anilino group, an N-alkylanilino group, an N-arylanilino group, an N-acylanilino group, a hydroxy group, or a mercapto group.

13. The photographic silver halide emulsion as claimed in claim 6, wherein $R_3$ is a phenyl group in which at least one of the ortho positions is substituted with an alkyl group, an alkoxy group or a halogen atom.

* * * * *